United States Patent [19]

Hillinger

[11] Patent Number: 4,465,113

[45] Date of Patent: Aug. 14, 1984

[54] ROLLER MAUL

[75] Inventor: George Hillinger, Los Angeles, Calif.

[73] Assignee: Alltrade Inc., Commerce, Calif.

[21] Appl. No.: 464,846

[22] Filed: Feb. 8, 1983

[51] Int. Cl.[3] ..... B27L 7/00; B26B 23/00

[52] U.S. Cl. ..... 144/193 D; 144/193 C; 145/2 R; 254/104

[58] Field of Search ..... 145/2 R; 254/104; 144/193 R, 193 C, 193 D; D8/47

[56] References Cited

U.S. PATENT DOCUMENTS 4,382,459 5/1983 Bartok ..... 144/193 D

*Primary Examiner*—W. D. Bray

*Attorney, Agent, or Firm*—William W. Glenny

[57] ABSTRACT

A splitter head including a body generally symmetrical about a central vertical plane, the lower portion of the body being bounded by opposed smooth-surfaced side walls converging downwardly to terminate in a cutting edge lying in the central plane. Spaced upwardly from the cutting edge, first and second sets of rollers are mounted in ports formed in the body, the rollers being rotatable about axes parallel to and disposed on opposite sides of the plane. The outer cylindrical surfaces of the rollers lie outwardly of the side walls. The upper body portion is defined by upper continuations of the side walls and recessed in at least one of the continuation walls there is provided a layer of phosphorescent material covered by a protective translucent coating. The side walls in the lower portion of the body may be formed to provide recesses flanking a central smooth vertical strip extending upwardly from just above the roller ports.

9 Claims, 5 Drawing Figures

ROLLER MAUL

BACKGROUND AND SUMMARY OF THE INVENTION

This invention relates generally to cutting tools, and more particularly to a splitting head or wedge having antifriction means to facilitate use, and phosphorescent safety identifying means to minimize injury in locating the tool in a dark environment.

Prior devices have been proposed in this general field, including those shown in U.S. Pat. No. 3,865,163 to Root and U.S. Pat. No. 4,044,808 to Kolonia, which provide levered means intended to facilitate splitting a workpiece such as a log. The present invention improves over those devices and provides a blade having a downwardly directed cutting edge, and a plurality of rollers mounted in the blade body on horizontal axes. The outer cylindrical surfaces of the rollers extend outwardly of the adjacent side walls of the blade, which converge downwardly from a upper maximum blade thickness to the cutting edge. The surfaces of the side walls are desirably smooth so that, if portions of the workpiece contact the sidewalls despite the spreading effect of the rollers, friction of such contact will be minimized. Portions of the blade side walls may be recessed, leaving only relatively narrow smooth strips to possibly be contacted by the workpiece during use. Above the level of maximum blade thickness, the head may have formed therein a recess bearing a layer of phosphorescent material, protected by a translucent coating, to serve as a useful identifying and locating means for the tool where the light level is low.

DETAILED DESCRIPTION

Figure 1:
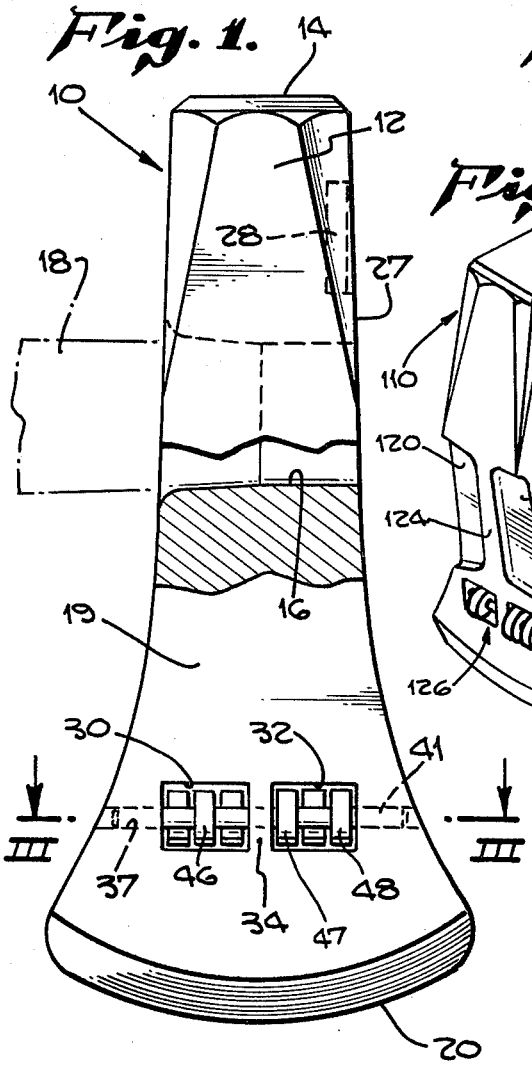
FIG. 1 is a side elevational view of a splitter wedge embodying the present invention, with the end portion of a handle fragmentarily shown in dotted outline.

A splitter head of the present invention is indicated generally at 10, and includes an upper portion 12 terminating upwardly in a flat anvil 14. The head is provided with an opening 16 for receiving the end of an axe handle, fragmentarily shown in dotted outline at 18 in FIG. 1, and the head includes a lower blade portion 19 which terminates downwardly in an arcuate cutting edge 20. The parts thus far described are conventional and well known in the art.

Figure 4:
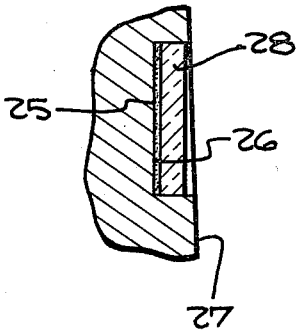
FIG. 4 is a fragmentary sectional view taken on arrows IV—IV of FIG. 2.

In the upper portion 12 of the head there are provided safety means for identifying and locating the present cutting tool in places of low or no illumination such as a tool shed. These safety means, as best seen in FIG. 4, include a quantity of phosphorescent material 25 applied to a surface 26 which is recessed inwardly from the adjacent surface 27 of the head. Over the phosphorescent material there is provided a translucent protective coating 28, housed within the recess and thus protected from abrasive contact during use of the tool.

Figure 3:
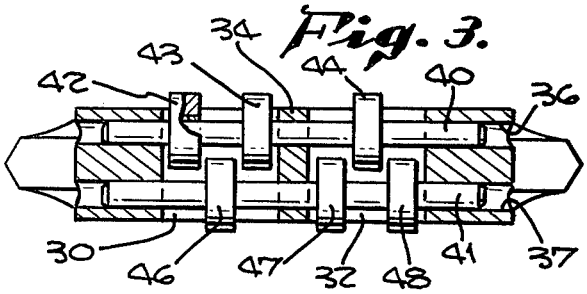
FIG. 3 is a sectional view taken on arrows III—III of FIG. 1.

Means are provided in accordance with the invention for facilitating both the entering of the lower cutting portion of the tool into a workpiece, and also the subsequent removal of the tool. Thus the body of blade 19 has formed therein a pair of rectangular ports 30 and 32 divided by a central partition or septum 34. A pair of laterally spaced bores 36 and 37, best seen in FIG. 3 are formed in the blade body, extending across ports 30 and 32 and through partition 34. Rods 40 and 41 are fixedly mounted in bores 36 and 37, the ends of the rods being recessed inwardly from the outer ends of the bores.

Figure 2:
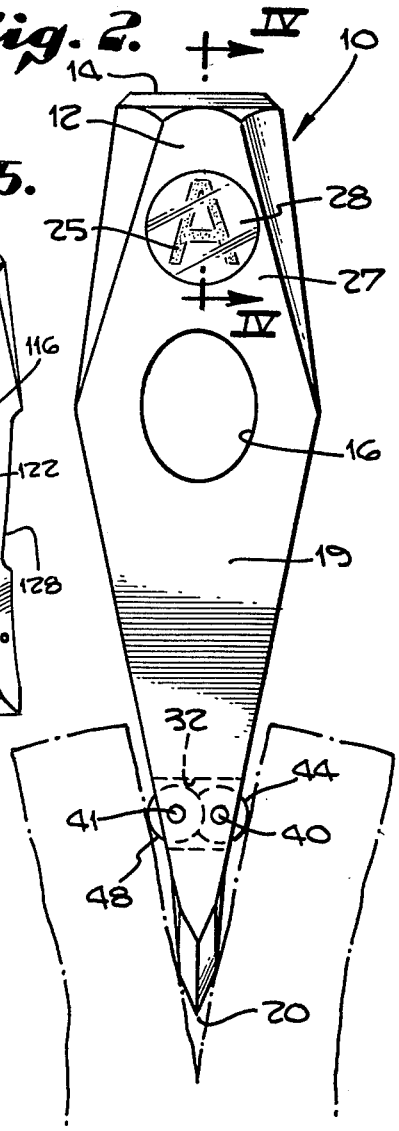
FIG. 2 is an end view thereof, together with, in dotted outline, a workpiece being split by the wedge.

Antifriction means are journaled on rods 40 and 41. Here such means are shown as including rollers 42, 43 and 44 rotatably mounted on rod 40, and rollers 46, 47 and 48 rotatably mounted on rod 41. The rollers are cylindrical, and their outer arcuate portions extend well beyond the adjacent side walls of blade 19, so that the exposed portions will contact the side walls of the partially split workpiece, as seen in FIG. 2, thus greatly diminishing the frictional component of the resistance of the workpiece to penetration by the blade.

As best seen in FIG. 3, the rollers on one rod are interleaved with the rollers on the other rod, with their circumferences overlapping thus permitting, for a given diameter of roller, the rods to be placed closer to the cutting edge than would otherwise be the case. Otherwise stated, and assuming that all rollers are of the same diameter, as is desirable, the axes of the two rods 40 and 41 are spaced apart by a distance less than twice the radius of a roller.

Figure 5:
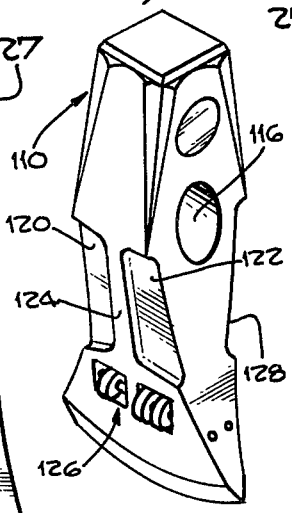
FIG. 5 is a perspective view of a modified form of the wedge.

In FIG. 5 there is shown a modified form of the invention comprising a head indicated generally at 110 similar in many respects to head 10 heretofore described. Modified head 110 includes a blade body 119 whose side wall seen in FIG. 5 is provided with a pair of recesses 120 and 122 flanking a central vertical strip 124. This strip, which is desirably polished and smooth, extends from just above the roller assembly indicated generally at 126 up to approximately the thickest section of the head, about even with the opening 116 in head 110. Central strip 124 is no wider than the width of the roller assembly 126, and is desirably substantially narrower than that width. As indicated at 128, the opposite side wall is similarly formed, so that the entire head 110, like head 10, is essentially symmetrical about a vertical central plane. Thus, in the event that portions of a workpiece tend to contact head 110 above roller assembly 126, the friction resulting from such contact will be minimized.

Minor modifications and changes from the illustrative forms of the invention are within the contemplation of the invention and are intended to be embraced within the scope of the following claims.

What is claimed is:

1. A cutting tool including a blade body having a relatively thick upper section and a pair of side walls converging downwardly to a cutting edge, the body having mounted therein antifriction means having movable surfaces extending beyond the side walls, the antifriction means including a respective cylindrical roller mounted to the body for rotation about each of a pair of horizontally aligned axes, each roller having a cylindrical surface constituting one of said movable surfaces and the rollers being axially offset from one another, the axes being laterally spaced by a distance less than the sum of the radii of the two rollers.

2. The invention as defined in claim 1 wherein the surfaces of said side walls are smooth.

3. The invention as defined in claim 1 wherein said body has formed therein opening means for partially housing said antifriction means.

4. The invention as defined in claim 3 wherein said opening means comprise a pair of laterally spaced ports.

5. The invention as defined in claim 1 wherein said side walls have formed therein recesses flanking a central smooth surfaced strip extending from above said antifriction means to substantially the level of said thick upper section.

6. The invention as defined in claim 1 wherein the body upper section includes phosphorescent safety identifying means.

7. The invention as defined in claim 6 wherein a wall of said body upper section has formed therein a recess, and wherein said identifying means include a layer of phosphorescent material in said recess.

8. The invention as defined in claim 7 including a protective coating of translucent material covering said phosphorescent material.

9. The invention as defined in claim 1 wherein the roller on each axis is one of a plurality of rollers on that axis, and each roller on one axis is axially offset from the rollers on the other axis.

* * * * *